US006652250B2

(12) United States Patent
Yoshimura

(10) Patent No.: US 6,652,250 B2
(45) Date of Patent: Nov. 25, 2003

(54) SCREW COMPRESSOR HAVING INTERMEDIATE SHAFT BEARING

(75) Inventor: Shoji Yoshimura, Takasago (JP)

(73) Assignee: Kobe Steel, Ltd., Kobe (JP)

( * ) Notice: Subject to any disclaimer, the term of this patent is extended or adjusted under 35 U.S.C. 154(b) by 0 days.

(21) Appl. No.: 09/977,403

(22) Filed: Oct. 16, 2001

(65) Prior Publication Data

US 2002/0044876 A1 Apr. 18, 2002

(30) Foreign Application Priority Data

Oct. 16, 2000 (JP) ..... 2000-315159
Dec. 15, 2000 (JP) ..... 2000-382035

(51) Int. Cl.[7] ..... F04B 17/03

(52) U.S. Cl. ..... 417/410.4; 417/357; 417/365; 417/423.1; 417/423.15; 412/423.12; 412/424.1; 418/201.1; 418/201.2; 418/201.3

(58) Field of Search ..... 417/357, 365, 417/423.1, 423.15, 423.11, 423.14, 410.4; 412/423.12, 424.1; 418/201.1, 201.3, 201.2

(56) References Cited

U.S. PATENT DOCUMENTS 4,770,615 A 9/1988 Fujiwara et al. ..... 418/15
4,780,061 A 10/1988 Butterworth ..... 417/371
4,878,820 A * 11/1989 Doi et al. ..... 418/203
4,913,634 A 4/1990 Nagata et al. ..... 418/47
5,207,568 A * 5/1993 Szymaszek ..... 418/203
5,695,327 A * 12/1997 Heinen et al. ..... 418/144
6,287,088 B1 * 9/2001 Nishimura et al. ..... 417/297
6,488,480 B1 * 12/2002 Zhong ..... 417/310
2002/0044876 A1 * 4/2002 Yoshimura ..... 417/410.4

FOREIGN PATENT DOCUMENTS

JP 10103265 A * 4/1998 ..... F04C/18/16
JP 11-351168 12/1999

* cited by examiner

*Primary Examiner*—Charles G. Freay
*Assistant Examiner*—Emmanuel Sayoc
(74) *Attorney, Agent, or Firm*—Oblon, Spivak, McClelland, Maier & Neustadt, P.C.

(57) ABSTRACT

A screw compressor 1 comprises a screw compressor body 2 having a pair of female and male screw rotors 21 meshed with each other encased in a rotor casing 22, and a motor casing 4 having a motor 3 for driving a male rotor 21*b* of the screw rotor 21 encased therein. The screw compressor body 2 and the motor casing 4 are connected integrally. The male rotor 21*b* and the motor 3 are connected by a common rotor shaft 23. In the common rotor shaft 23, the counter motor 3 side is supported by a rolling bearing and a projecting end of the motor 3 is supported by a rolling bearing 7 on the motor side, and a portion between the motor 3 and the screw rotor 21 is supported by an intermediate rolling bearing 6.

7 Claims, 5 Drawing Sheets

SCREW COMPRESSOR HAVING INTERMEDIATE SHAFT BEARING

BACKGROUND OF THE INVENTION

1. Field of the Invention

The present invention relates to a technical field of a screw compressor.

2. Description of the Related Art

A conventional screw compressor heretofore known, as shown in FIG. 6, has the constitution in which a male rotor and a motor out of a pair of female and male screw rotors have a mutual shaft in common. In this case, since a coupling for connecting a shaft of the screw rotor and a shaft of the motor is unnecessary, it is economically advantageous. However, despite that the weight of a rotor of the motor is heavy, a rotor shaft for supporting the rotor is supported by way of only the screw rotor side, and therefore, the critical speed (rotational speed when the bending natural frequency in the flexing direction of a rotational shaft coincides with the rotational frequency) of the screw rotor is low. This screw compressor is applied to an oil cooling type screw compressor. In that case, since the compressor is operated at the low speed rotation of about 3600 rpm, it can be always operated at a rotational speed less than the critical speed, the possibility posing a problem being low.

Incidentally, a consideration is made that the screw compressor is applied to an oil free screw compressor. Then, the possibility of operation at the high speed rotation about 20000 rpm, that is, the rotational speed in excess of the critical speed, increases. That is, there is the time exceeding the critical speed. Then, as shown in FIG. 7 of an explanatory view of a relationship between the rotational frequency when passing through the critical speed (at the start time) and the amplitude, the amplitude of the rotor shaft increases directly after exceeding the critical speed, increasing the possibility that an inconvenience occurs in contact of screw rotors. Therefore, it has been difficult to employ the conventional screw compressor for the oil free screw compressor.

Incidentally, there is contemplated the measures that as shown in FIG. 7, since the amplitude of the rotor shaft gradually becomes small as assuming the higher speed rotation than the critical speed, the speed increasing acceleration of the rotational frequency of the rotor is increased when exceeding the critical speed to allow the rotational frequency at which the amplitude of the rotor shaft increases to pass through in a short period of time. However, this has a limit naturally, and is not always practical.

SUMMARY OF THE INVENTION

It is an object of the present invention to provide a screw compressor capable of being operated at a speed less than the critical speed while raising the critical speed than that of prior art. A further object of the present invention is to provide a screw compressor capable of being applied to an oil free screw compressor, without occurrence of inconvenience of the contact of screw rotors.

The screw compressor according to the present invention comprises a compressor body comprising a pair of female and male screw rotors meshed with each other, a rotor casing for encasing the screw rotors, a motor for driving one out of the screw rotors, and a motor casing for encasing the motor and connected integral with the rotor casing (of the compressor body). One out of the screw rotors and the motor have a shaft in common. Opposite ends of the shaft are supported by bearings. A portion between the motor and the screw rotor is supported by an intermediate bearing.

Preferably, a seal part is peripherally provided between a bearing located on the end side of the shaft on the motor side and the motor, and between the motor and the screw rotor.

Further, preferably, compression gas of higher pressure than that acting on the seal part between the motor and the screw rotor is introduced into the motor casing.

Further, a bearing for supporting opposite ends of the shaft and the intermediate bearing may comprise a rolling bearing.

Further, a motor may be disposed on the suction side of the screw rotor, and a pressure receiving portion at which generates the force in a direction from the motor toward the screw rotor may be provided on the end on the motor side of the shaft.

Further, the pressure receiving portion may comprise a piston of a cylinder portion.

Furthermore, a pressure receiving portion may be provided in close contact with a piston member provided, in the periphery of an outer race of a bearing, integral with the outer race and capable of being moved forward and backward in the longitudinal direction of an output shaft, and the piston member and a screw rotor with respect to the piston member may comprise a diaphragm for partitioning a space portion on the opposite side.

DETAILED DESCRIPTION OF THE PREFERRED EMBODIMENTS

Figure 2:
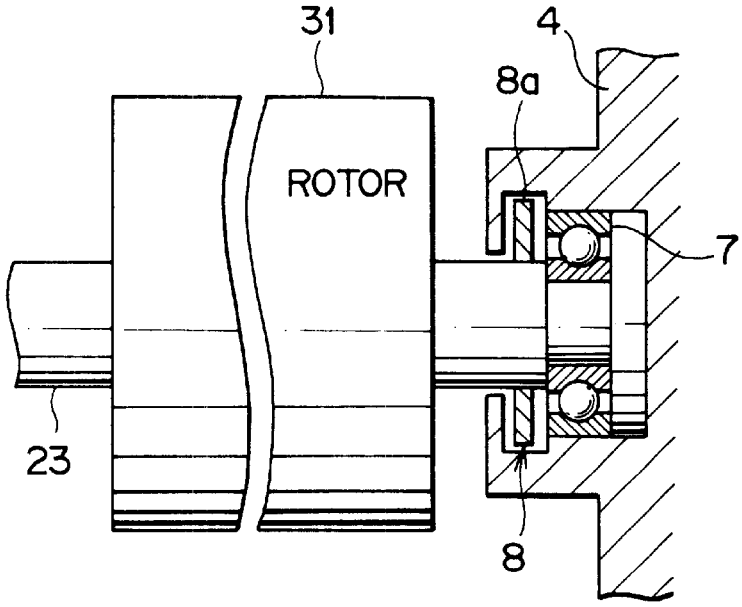
FIG. 2 is an explanatory view of a seal portion in the embodiment of the present invention.
Figure 3:
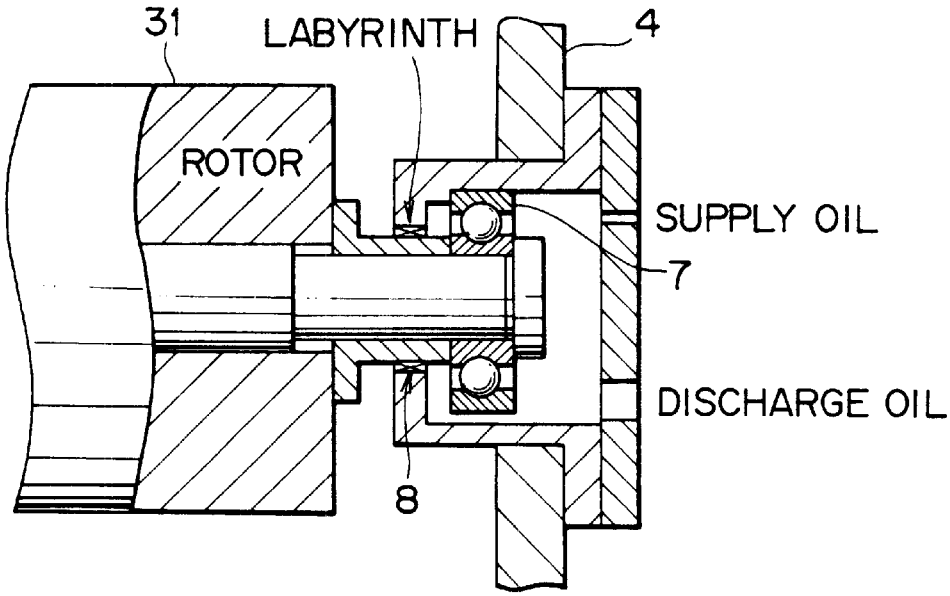
FIG. 3 is an explanatory view of a seal portion in the embodiment of the present invention.

The screw compressor according to an embodiment of the present invention will be described hereinafter with reference to FIG. 1, an explanatory view of a plan sectional constitution, and FIGS. 2 and 3, respectively, explanatory views of a constitution of a seal portion in order.

Figure 1:
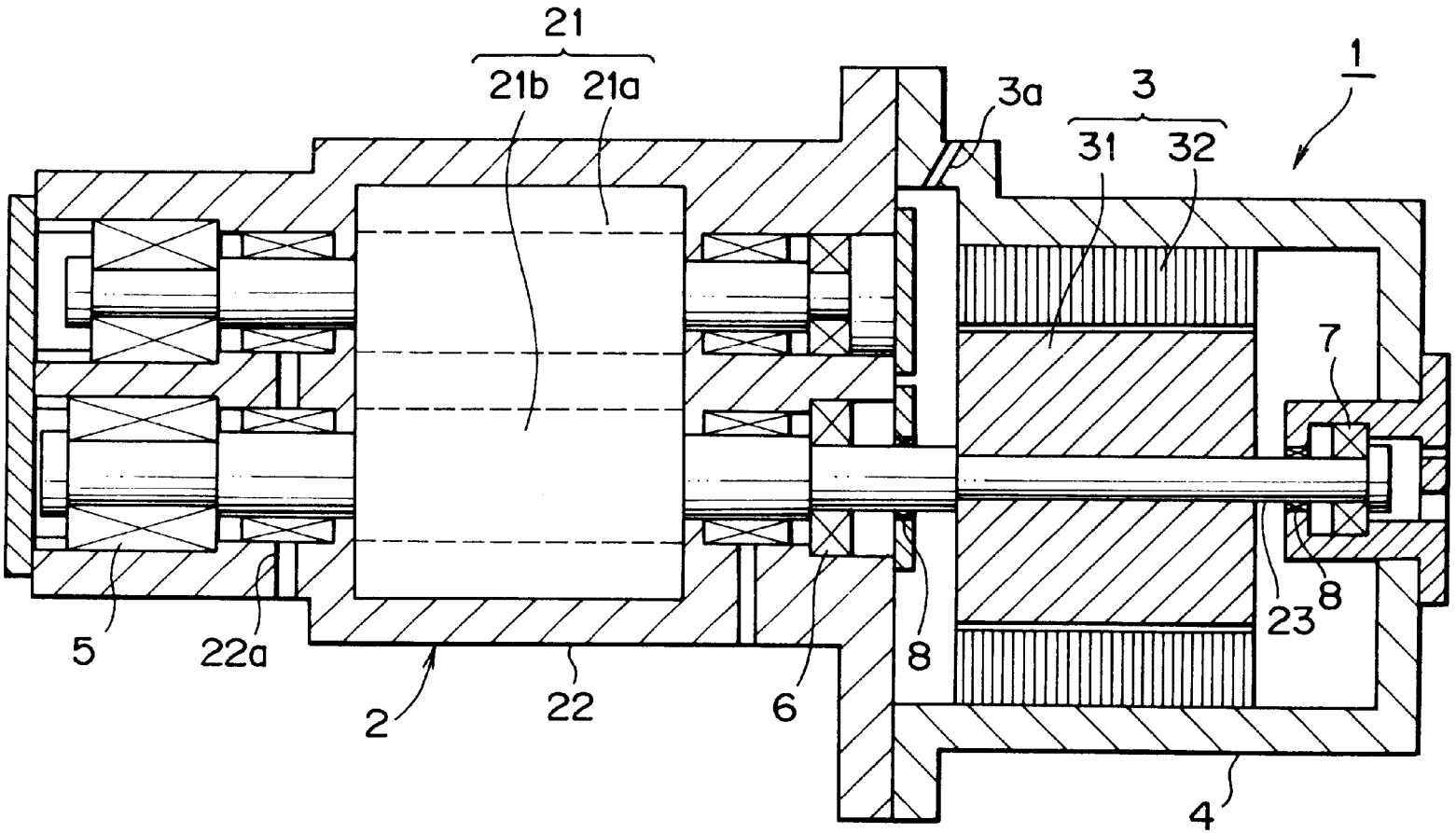
FIG. 1 is an explanatory view of a screw compressor according to an embodiment of the present invention.

Reference numeral 1 shown in FIG. 1 denotes a screw compressor according to an embodiment of the present invention. This screw compressor is a so-called oil free screw compressor. The screw compressor 1 comprises a screw rotor 21 comprising a female rotor 21*a* having shaft parts of opposite ends supported by bearings and a male rotor 21*b* meshed with the female rotor 21*a*, and a screw compressor body 2 comprising a rotor casing 22 having the screw rotor 21 encased therein. A motor casing 4 having a motor 3 encased therein comprising a rotor 31 and a stator 32 is integrally mounted on one side of the screw compressor 2. A rotor shaft of the male rotor 21*b* out of the pair of female and male screw rotors 21 is in common with a rotor shaft of the motor 3.

On the counter motor 3 side of the screw rotor 21 of the rotor casing 22 is disposed a rotor side rolling bearing 5 comprising a combination of three angular contact bearings and one roller bearing. On the motor 3 side is disposed an intermediate rolling bearing 6 comprising a needle roller bearing which is an intermediate bearing. On the counter screw rotor 21 of the motor 3 of the motor casing 4 is disposed a motor side rolling bearing 7 comprising a ball bearing. All of the rotor side rolling bearing 5, the intermediate rolling bearing 6 and the motor side rolling bearing 7 are fitted in a bearing cage with which a lubricating oil supply passage is communicated.

A projecting end from the male rotor 21*b* of the common rotor shaft 23 which is a common shaft of the male rotor 21*b* and the motor 3 is fitted in the rotor side rolling bearing 5. A portion between the male rotor 21 and the motor 3 of the common rotor 23 is fitted in the intermediate rolling bearing 6. The projecting end from the motor 3 is fitted in the motor side rolling bearing 7 whereby the common rotor shaft 23 is supported at three points. Because, if the constitution is made such that the common rotor shaft 23 is supported at three points as described, the critical speed of the common rotor shaft 23 can be enhanced positively.

Seal parts 8 are respectively peripherally provided between the intermediate rolling bearing 6 and the motor 3, of the common rotor shaft 23, and between the intermediate rolling bearing 6 side, the motor side rolling bearing 7 and the motor 3. As these seal parts 8, there can be employed, for example, a carbon seal, a mechanical seal, an oil seal, and in addition, a labyrinth seal as shown in FIG. 2, and a seal of the type provided with a thrower disk 8*a* which blows away oil by the centrifugal force as shown in FIG. 3.

Further, a compressed air discharge port 22*a* for discharging a leaking portion of compressed air which is a compressed gas compressed by the screw rotor 21 is provided in the rotor casing 3, and an air introducing pipeline not shown is communicated with an air inlet 3*a* provided in the motor casing 4 from the compressed air discharge port 22*a*. That is, compressed air discharged out of the compressed air discharge port 22*a* is introduced into the motor casing 3 through the air inlet 3*a*.

The reason why compressed air is introduced into the motor casing 3, in addition to the seal part 8, is to aim at preventing a leakage of lubricating oil to the motor casing 4 supplied from the lubricating oil supply passage to the bearing cage more positively. That is, since by the provision of such arrangement as described, contact of the motor 3 of lubricating oil with the rotor 31 is prevented more positively, it is possible to avoid the possibility of the insulating breakage of the rotor 31 due to carbonization of lubricating oil. A shaft seal device is interposed between the screw rotor 21 and the rotor side rolling bearing 5, and between the screw rotor 21 and the intermediate rolling bearing 6.

The projecting end from the motor 3 of the common rotor shaft 23 which is a common shaft of the male rotor 21*b* and the motor 3 is fitted in the motor side rolling bearing 7 to thereby provide restriction. Therefore, this is not the constitution of a cantilever support which is a support by way of only the screw rotor side unlike the common rotor shaft in prior art, and the natural frequency of the common rotor shaft 23 increases. There has been also proposed a screw compressor having the constitution which is not provided with an intermediate rolling bearing, but as compared therewith, the screw compressor 1 according to the present embodiment is able to further enhance the natural frequency of the common rotor shaft. By the constitution in which the common rotor is supported at three points, the flexure of the common rotor shaft can be suppressed, and the contact between the rotors can be prevented.

Accordingly, the critical speed increases so that for example, even if the screw compressor 1 is an oil screw compressor, operation within the critical speed becomes enabled, thus providing the excellent effect capable of eliminating possible occurrence of inconvenience in contact between the female rotor 21*a* and the male rotor 21*b* of the screw rotor 21.

Further, while in the screw compressor 1 according to the present embodiment, the common rotor shaft 23 is supported at three points, i.e., the rotor side rolling bearing 5, the intermediate rolling bearing 6 and the motor side rolling bearing 7, it is noted that generally, a rolling bearing is small in clearance in the bearing as compared with a slide bearing. Therefore, a clearance between a pair of female and male screw rotors 21 can be also made small, thus providing the effect capable of further enhancing the performance as the screw compressor 1.

The screw compressor according to a further embodiment will be described hereinafter with reference to FIGS. 4 and 5.

Figure 4:
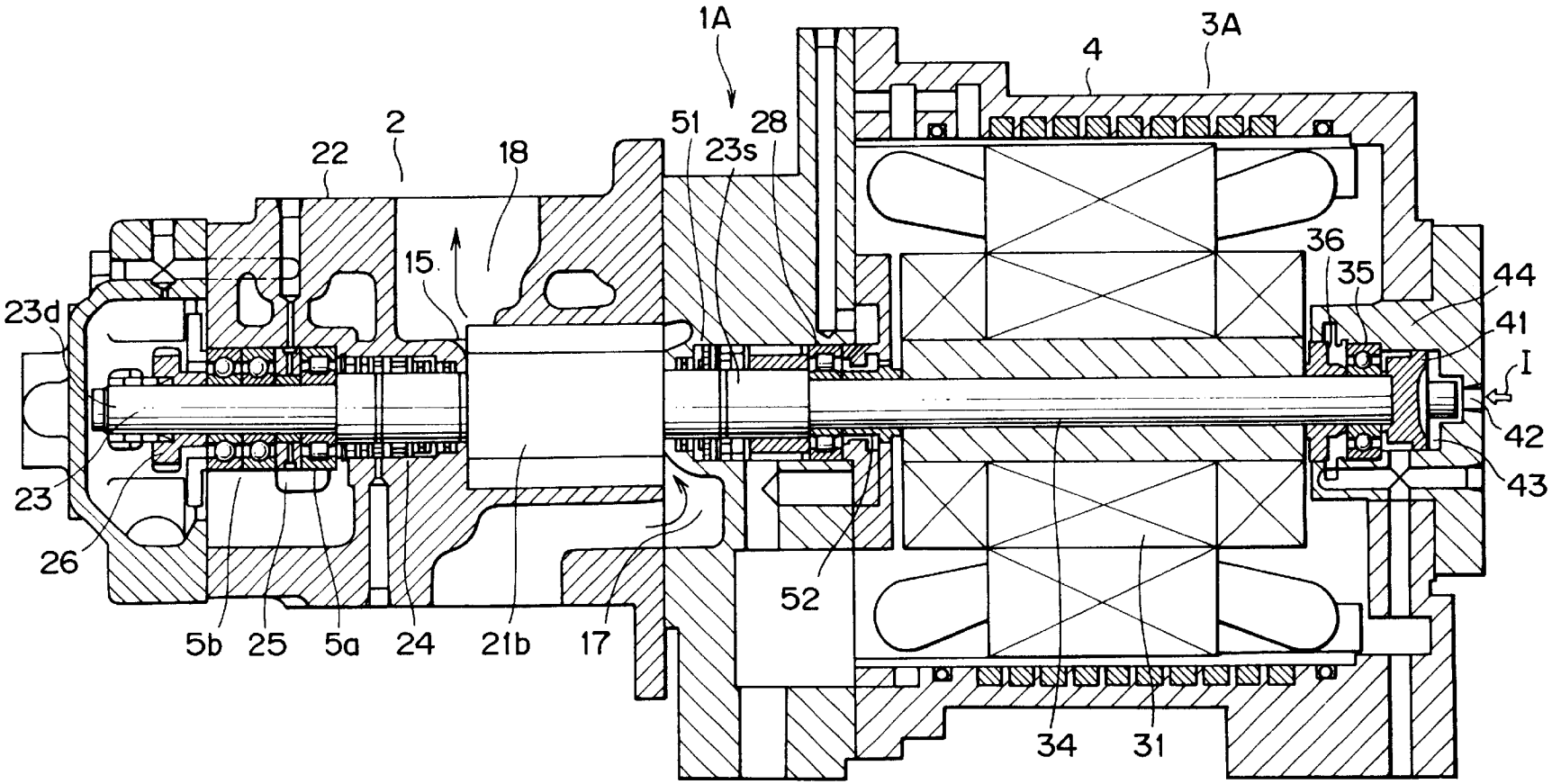
FIG. 4 is an explanatory view of a screw compressor in the embodiment of the present invention.

FIG. 4 shows an oil free screw compressor 1A according to an embodiment of the present invention, separately from one that described above. The oil free screw compressor 1A comprises a compressor body 2, and a motor 3A which is a drive part having a motor casing 4 connected integral with a rotor casing 22 of the compressor body 2. A pair of female and male screw rotors meshed with each other are rotatably encased in a rotor chamber 15 in the rotor casing 22. In FIG. 4, only the male rotor 21*b* on the drive side is shown.

The rotor casing 22 is formed with a suction port 17 opened to one end of the rotor chamber 15, and a discharge port 18 opened to the other end. A shaft 23*d* extended on the discharge side of the male rotor 21*b* is supported by bearings 5*a* and 5*b*, and shaft seal parts 24, 25 are provided between the bearing 5*a* and the male rotor 21*b* and between the bearings 5*a*, 5*b*, respectively. Further, a synchronous gear 26 is provided on the end of the shaft 23*d*. The synchronous gear 26 is meshed with a synchronous gear provided on the end of a shaft of the other screw rotor not shown, that is, the female rotor 21*a* to function to transmit the rotating force to the female rotor 21*a*. Further, a shaft 23*s* extended on the suction side of the male rotor 21*b* is supported by a bearing 28, and shaft seal parts 51, 52 are provided on both sides of the bearing 28.

The motor 3A is arranged on the suction side of the compressor body 2, an output shaft 34 extending through the center part of a rotor 31 is integrally formed on the same shaft as the shaft 23*s* extended on the suction side of the male rotor 21*b*, that is, the motor 3A and the male rotor 21*b* have a shaft in common. That is, the shafts 23*d*, 23*s* and the output shaft 34 form an integral rotor shaft 23. The bearing 28 acts to support one end of the output shaft 34. Further, the side opposite to the bearing 28 of the output shaft 34 is supported on the bearing 35, and a shaft seal part 36 is provided between the bearing 35 and the rotor 34. Further, on the other end of the output shaft 34 extending through the bearing 35, that is, the end opposite to the male rotor 21*b* of the output shaft 34 is provided a piston 41 as a pressure receiving part which generates the force caused by fluid pressure in the direction from the other end to the one end, that is, in the direction from the motor 3A to the male rotor 21*b*.

That is, there is provided a cylinder part 44 into which is inserted a piston 41 capable of being moved forward and backward in a space 43 to which is supplied fluid pressed as indicated by arrow I from an inlet/outlet 42 formed in the motor casing 4 on the end side of the other end. Counter thrust acts on the shafts 23*d* and 23*s* through the output shaft 34 from the piston 41. Preferably, the pressed fluid is oil.

Since as described above, in the oil free screw compressor 1A, the motor 3A is provided on the suction side of the male rotor 21*b*, gas is not blown through the motor 3A from the rotor chamber 15. There are not brought forth scattering of oil to the rotor 31, inferior insulation at the rotor 31, and lowering of performance due to the stirring loss of oil, which occur in a case where gas is blown through, thus enabling relieving the force in the thrust direction acting on the shafts 23*b*, 23*s* of the male rotor 21*b* to prolong the service life of bearings.

Figure 5:
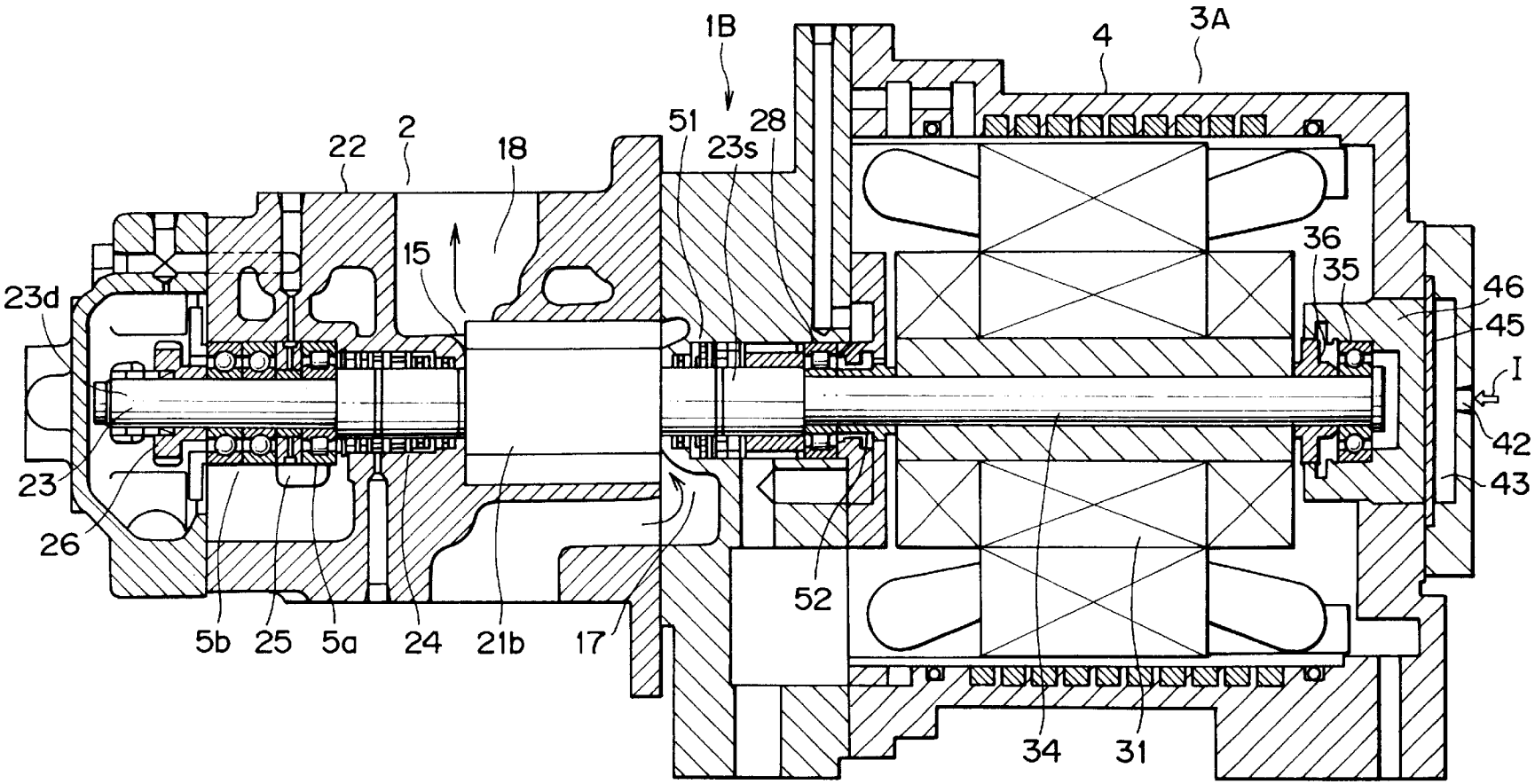
FIG. 5 is an explanatory view of a screw compressor in the embodiment of the present invention.
Figure 6:
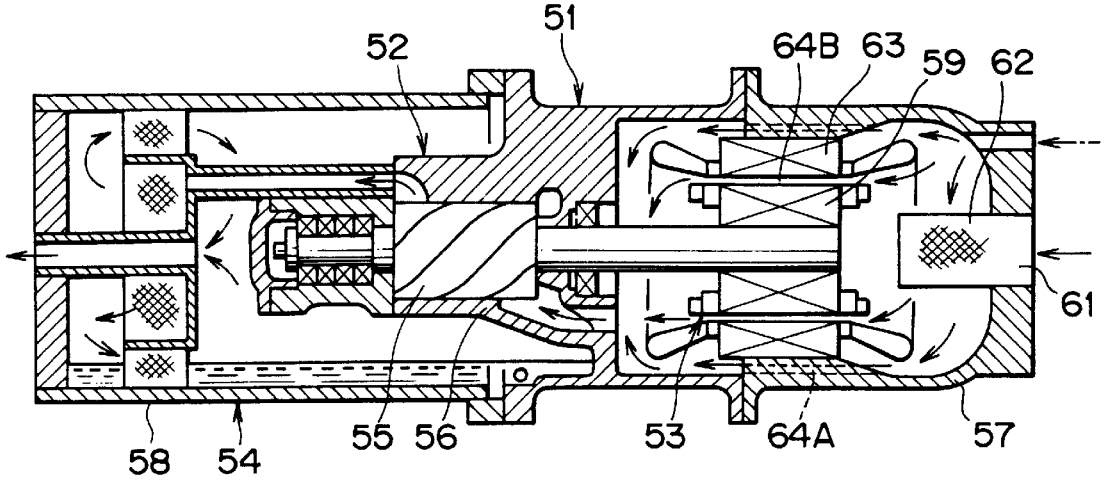
FIG. 6 PRIOR ART
FIG. 6 is an explanatory view of a relationship between the rotational frequency at the time of passing a critical speed (at the start time) and the amplitude.
Figure 7:
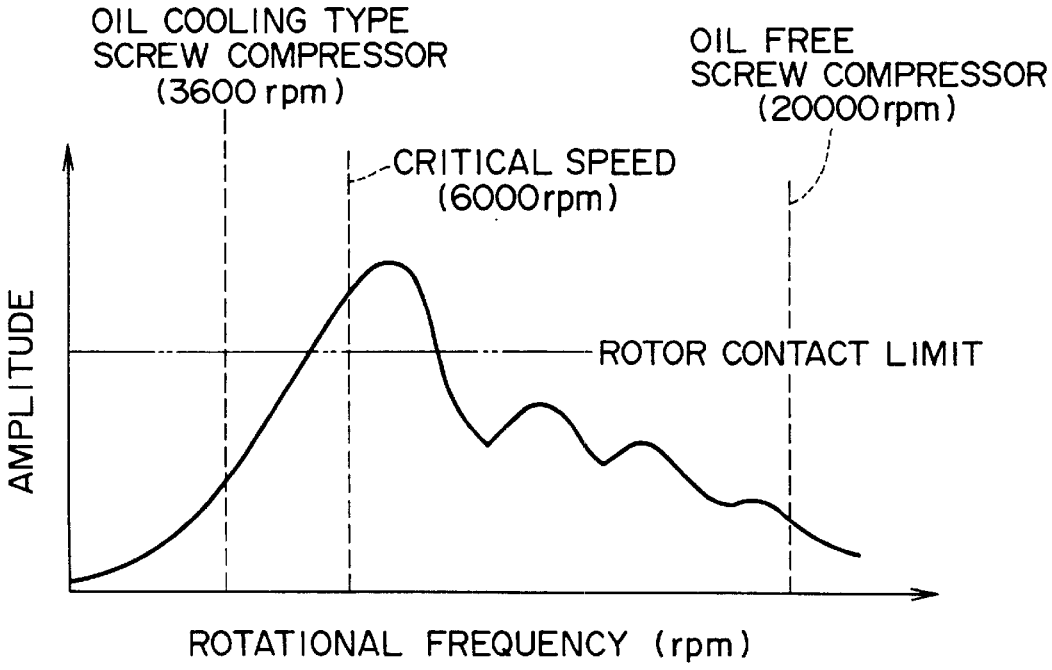
FIG. 7 is an explanatory view of a relationship between the rotational frequency at the time of passing a critical speed (at the start time) and the amplitude.

FIG. 5 shows an oil free screw compressor 1B according to an embodiment of the present invention, separately from one that described above. The parts common to the oil free screw compressor 1A shown in FIG. 4 are indicated by the same numerals, explanation of which is omitted.

In the oil free screw compressor 1B, a diaphragm 45 having flexibility is provided on the other end of the side opposite to male rotor 21*b* side of the output shaft 34, as a pressure receiving part which generates the force caused by fluid pressure in the direction from the other end toward one end on the male rotor 21*b* side.

That is, there is provided the diaphragm 45, in the periphery of an outer race of he bearing 35 disposed on the other end of the output shaft 34, in close contact with a piston member 46 provided capable of being moved forward and backward in a longitudinal direction extending through the end surface of the motor casing 4, to airtightly partition between the piston member 46 and the space 43 opposite to the male rotor 21*b* with respect to the piston member 46. The diaphragm 45 receives pressure in the space 43 to act the counter thrust on the output shaft 34 through the piston member 46 and the bearing 35 to transmit the counter thrust to the shafts 23*d*, 23*s*. Preferably, the fluid pressed is compression gas.

As a result, there are not brought forth scattering of oil to the rotor 31, inferior insulation at the rotor 31, and lowering of performance due to the stirring loss of oil, which occur in a case where gas is blown through, thus enabling relieving the force in the thrust direction acting on the shafts 23*b*, 23*s* of the male rotor 21*b* to prolong the service life of bearings, similar to the case where the piston 41 described above is provided.

I claim:

1. A screw compressor comprising:

a compressor body having a pair of female and male screw rotors meshed with each other, said compressor body having a rotor casing for encasing said screw rotors;

a motor for driving one of said screw rotors;

a motor casing connected integrally with said rotor casing, said motor casing encasing said motor; and a shaft which is common to one of said screw rotors and said motor, opposite ends of said shaft being supported by bearings, a portion between said motor and said screw rotor being supported by an intermediate bearing.

2. The screw compressor according to claim 1, further comprising seal parts provided at the periphery of said shaft between said motor and one of said bearings positioned on the motor end of said shaft, and between said motor and said screw rotor, respectively.

3. The screw compressor according to claim 2, further comprising means for introducing into said motor casing compressed gas higher in pressure than pressure acting on the seal part between said motor and said screw rotor.

4. The screw compressor according to claim 1, wherein a bearing for supporting opposite ends of said shaft and said intermediate bearing comprise a rolling bearing.

5. The screw compressor according to claim 1, further comprising a motor disposed on the suction side of said screw rotor, and a pressure receiving part which generates the force in the direction from said motor toward said screw rotor on the end on the motor side of said shaft.

6. The screw compressor according to claim 5, wherein said pressure receiving part comprises a piston of a cylinder part.

7. The screw compressor according to claim 5, wherein said pressure receiving part comprises a diaphragm provided, in the periphery of an outer race of a bearing, in close contact with a piston member provided integral with said outer race and capable of being moved forward and backward in a longitudinal direction of said output shaft, to partition said piston member and a space part opposite to said screw rotor with respect to said piston member.

* * * * *